US011798450B2

(12) United States Patent
Ma et al.

(10) Patent No.: US 11,798,450 B2
(45) Date of Patent: Oct. 24, 2023

(54) DISPLAY DRIVING DEVICE, CONTROL METHOD THEREFOR, AND DISPLAY APPARATUS

(71) Applicant: BOE TECHNOLOGY GROUP CO., LTD., Beijing (CN)

(72) Inventors: Xitong Ma, Beijing (CN); Lihua Geng, Beijing (CN); Yanfu Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 509 days.

(21) Appl. No.: 17/256,094

(22) PCT Filed: Jan. 19, 2020

(86) PCT No.: PCT/CN2020/073025

§ 371 (c)(1),
(2) Date: Dec. 24, 2020

(87) PCT Pub. No.: WO2020/156284

PCT Pub. Date: Aug. 6, 2020

(65) Prior Publication Data

US 2021/0272496 A1 Sep. 2, 2021

(30) Foreign Application Priority Data

Jan. 28, 2019 (CN) ..... 201910080264.5

(51) Int. Cl.
*G09G 3/20* (2006.01)
*G09G 5/36* (2006.01)
*G09G 5/399* (2006.01)

(52) U.S. Cl.
CPC ..... *G09G 3/20* (2013.01); *G09G 5/363* (2013.01); *G09G 5/399* (2013.01);
(Continued)

(58) Field of Classification Search
CPC .... G09G 5/363; G09G 5/399; G09G 2230/00; G09G 2310/02; G09G 2310/04; G09G 2320/08
See application file for complete search history.

(56) References Cited

U.S. PATENT DOCUMENTS 9,190,000 B2 11/2015 Tan et al.
2010/0302214 A1 12/2010 Kim et al.
(Continued)

FOREIGN PATENT DOCUMENTS

CN 103065595 A 4/2013
CN 104240635 A 12/2014
(Continued)

OTHER PUBLICATIONS

Extended European Search Report dated Sep. 26, 2022 received in European Patent Application No. EP 20749432.9.

*Primary Examiner* — Todd Buttram
(74) *Attorney, Agent, or Firm* — Scully, Scott, Murphy & Presser, P.C.

(57) ABSTRACT

A display driving device and a control method thereof, and a display device. The control method includes: generating, by the master processing chip, a read/write synchronization signal, and receiving, by each of the slave processing chip, the read/write synchronization signal; in response to the read/write synchronization signal, caching, by the master processing chip, the received display data of the current to-be-displayed frame image into the frame address of the corresponding memory, reading and processing cached display data of a previous to-be-displayed frame image and transmitting the processed display data; and in response to the read/write synchronization signal, caching synchronously, by each of the slave processing chip, the received display data of the current to-be-displayed frame image into the frame address of the corresponding memory, and reading
(Continued)

and processing synchronously cached display data of the previous to-be-displayed frame image and transmitting the processed display data.

20 Claims, 3 Drawing Sheets

(52) U.S. Cl.
CPC ... *G09G 2310/08* (2013.01); *G09G 2360/121* (2013.01); *G09G 2360/128* (2013.01)

(56) References Cited

U.S. PATENT DOCUMENTS

| | | | | |
|---|---|---|---|---|
| 2012/0002009 | A1 | 1/2012 | Ikuta et al. | |
| 2013/0219101 | A1 | 8/2013 | Hansen et al. | |
| 2021/0090528 | A1 | 3/2021 | Zheng | |
| 2021/0272496 | A1 * | 9/2021 | Ma | G09G 5/397 |

FOREIGN PATENT DOCUMENTS

| | | | | | |
|---|---|---|---|---|---|
| CN | 108806626 | A | | 11/2018 | |
| CN | 109509424 | A | * | 3/2019 | G09G 3/20 |
| CN | 109509424 | A | | 3/2019 | |

* cited by examiner

DISPLAY DRIVING DEVICE, CONTROL METHOD THEREFOR, AND DISPLAY APPARATUS

CROSS-REFERENCE TO RELATED APPLICATION

The present application is a national stage entry of PCT International Application No. PCT/CN2020/073025, filed on Jan. 19, 2020, which claims priority to the Chinese Patent Application No. 201910080264.5, filed on Jan. 28, 2019, the disclosure of PCT International Application No. PCT/CN2020/073025 and the disclosure of Chinese Patent Application No. 201910080264.5 are incorporated herein by reference in its entirety as part of the present application.

TECHNICAL FIELD

Embodiments of the present disclosure relate to a display driving device and a control method thereof, and a display device.

BACKGROUND

Currently, a display panel is driven to display an image after display data of a to-be-displayed frame image is processed by a processing chip and then output to the display panel. With the appearance of high-resolution display panels, requirements on the memory bandwidth and the transmission interfaces become higher.

SUMMARY

At least one embodiment of the present disclosure provides a control method of a display driving device, the display driving device including: at least two processing chips and memories in signal connection with the at least two processing chips in a one-to-one correspondence; each of the memories including a plurality of frame addresses set in order; each to-be-displayed frame image including at least two image regions, and the at least two image regions being in a one-to-one correspondence with the at least two processing chips; one of the at least two processing chips being a master processing chip, and a remainder of the at least two processing chips being a slave processing chip;

wherein the control method includes:

receiving, by the master processing chip, display data of a corresponding image region in a current to-be-displayed frame image; receiving, by each of the slave processing chip, display data of a corresponding image region in the current to-be-displayed frame image;

generating, by the master processing chip, a read/write synchronization signal upon caching the received display data, and receiving, by each of the slave processing chip, the read/write synchronization signal;

in response to the read/write synchronization signal, caching, by the master processing chip, the received display data of the current to-be-displayed frame image into the frame address of the memory in signal connection with the master processing chip, reading and processing display data of a previous to-be-displayed frame image cached in the memory in signal connection with the master processing chip and transmitting the processed display data to a display panel; and in response to the read/write synchronization signal, caching, by each of the slave processing chip, the received display data of the current to-be-displayed frame image into the frame address of the memory in signal connection with each of the slave processing chip in synchronization with the master processing chip, and reading and processing display data of the previous to-be-displayed frame image cached in the connected memory in synchronization with the master processing chip and transmitting the processed display data to the display panel.

For example, in the embodiments of the present disclosure, the control method further includes: receiving, by the master processing chip, a frame start signal upon receiving the display data of the corresponding image region in the current to-be-displayed frame image; receiving, by the slave processing chip, the frame start signal upon receiving the display data of the corresponding image region in the current to-be-displayed frame image; and prior to the generating, by the master processing chip, the read/write synchronization signal upon caching the received display data, and receiving, by each of the slave processing chip, the read/write synchronization signal, the control method further including:

generating, by the master processing chip, a frame start synchronization signal according to the frame start signal, and receiving, by the slave processing chip, the frame start synchronization signal; and generating, by the master processing chip, a drive timing corresponding to the display data received by the master processing chip, in response to the frame start synchronization signal and the frame start signal; generating, by each of the slave processing chip, a drive timing corresponding to the display data received by the slave processing chip in synchronization with the master processing chip, in response to the frame start synchronization signal and the frame start signal.

For example, in the embodiments of the present disclosure, subsequent to the generating, by the master processing chip, the read/write synchronization signal upon caching the received display data, and receiving, by each of the slave processing chip, the read/write synchronization signal, the control method further includes:

in response to the read/write synchronization signal, caching, by the master processing chip, the received display data of the current to-be-displayed frame image and the corresponding drive timing into the frame address of the memory in signal connection with the master processing chip, reading and processing the display data of the previous to-be-displayed frame image and a corresponding drive timing cached in the memory in signal connection with the master processing chip and transmits the processed display data to the display panel; and in response to the read/write synchronization signal, synchronously caching, by each of the slave processing chip, the received display data of the current to-be-displayed frame image and the corresponding drive timing into the frame address of the memory in signal connection with each of the slave processing chip in synchronization with the master processing chip, reading and processing the display data of the previous to-be-displayed frame image and a corresponding drive timing cached in the memory in signal connection with each of the slave processing chip in synchronization with the master processing chip and transmitting the processed display data to the display panel.

For example, in the embodiments of the present disclosure, the image regions in each of the to-be-displayed frame image extend in a column direction of pixel units of the display panel and are arranged in a row direction of the pixel units of the display panel.

For example, in the embodiments of the present disclosure, the frame start signal is a field sync signal.

For example, in the embodiments of the present disclosure, in the memory, an order of the frame address caching the display data of the previous to-be-displayed frame image is before an order of the frame address caching the display data of the current to-be-displayed frame image.

For example, in the embodiments of the present disclosure, the frame address of the memory in signal connection with the master processing chip for caching the display data of the current to-be-displayed frame image is the same as the frame address of the memory in signal connection with each of the slave processing chip for caching the display data of the current to-be-displayed frame image.

For example, in the embodiments of the present disclosure, the frame address of the memory in signal connection with the master processing chip for caching the display data of the current to-be-displayed frame image is different from the frame address of the memory in signal connection with each of the slave processing chip for caching the display data of the current to-be-displayed frame image.

For example, in the embodiments of the present disclosure, sizes of the image regions are identical.

For example, in the embodiments of the present disclosure, the plurality of frame addresses of the memory in signal connection with the processing chip are used to store display data of each to-be-displayed frame image circularly in sequence.

Correspondingly, the embodiments of the present disclosure further provide a display driving device, which includes:

at least two processing chips, memories in signal connection with the at least two processing chips in a one-to-one correspondence, wherein each of the memories includes a plurality of frame addresses set in order; each to-be-displayed frame image includes at least two image regions, and the at least two image regions are in a one-to-one correspondence to the at least two processing chips; one of the at least two processing chips is a master processing chip, and a remainder of the at least two processing chips is a slave processing chip;

the master processing chip is configured to receive display data of a corresponding image region in a current to-be-displayed frame image and generate a read/write synchronization signal upon caching the received display data; in response to the read/write synchronization signal, to cache the received display data of the current to-be-displayed frame image into the frame address of the memory in signal connection with the master processing chip, read and process display data of a previous to-be-displayed frame image cached in the memory in signal connection with the master processing chip and transmit the processed display data to a display panel; and each of the slave processing chip is configured to receive display data of a corresponding image region in the current to-be-displayed frame image and the read/write synchronization signal; in response to the read/write synchronization signal, to cache the received display data of the current to-be-displayed frame image into the frame address of the memory in signal connection with the master processing chip in synchronization with the master processing chip, and read and process display data of the previous to-be-displayed frame image cached in the connected memory in synchronization with the master processing chip and transmit the processed display data to the display panel.

For example, in the embodiments of the present disclosure, the master processing chip is further configured to receive a frame start signal upon receiving the display data of the corresponding image region in the current to-be-displayed frame image, and generate a frame start synchronization signal according to the frame start signal; in response to the frame start synchronization signal and the frame start signal, to generate a drive timing corresponding to the display data received by the master processing chip; in response to the read/write synchronization signal, to cache the received display data of the current to-be-displayed frame image and the corresponding drive timing into the frame address of the memory in signal connection with the master processing chip, read and process the display data of the previous to-be-displayed frame image cached in the memory in signal connection with the master processing chip and a corresponding drive timing and transmit the processed display data and the processed corresponding drive timing to the display panel;

the slave processing chip is further configured to receive the frame start synchronization signal and receive the frame start signal upon receiving the display data of the corresponding image region in the current to-be-displayed frame image; in response to the frame start synchronization signal and the frame start signal, to generate a drive timing corresponding to the display data received by the slave processing chip in synchronization with the master processing chip; and in response to the read/write synchronization signal, to cache the received display data of the current to-be-displayed frame image and the corresponding drive timing into the frame address of the memory in signal connection with the slave processing chip in synchronization with the master processing chip, and read and process the display data of the previous to-be-displayed frame image cached in the memory in signal connection with the slave processing chip and a corresponding drive timing in synchronization with the master processing chip and transmit the processed display data and the processed corresponding drive timing to the display panel.

For example, in the embodiments of the present disclosure, each of the at least two processing chips is further configured to receive display data of a corresponding image region in at least two to-be-displayed frame images; to cache the received display data of the at least two to-be-displayed frame images into the memory in signal connection with the processing chip by circularly using the plurality of frame addresses of the memory in sequence, and based on the plurality of frame addresses of the memory, to circularly read and convert display data of the to-be-displayed frame image cached in the memory in signal connection with the processing chip in sequence, and to transmit the converted display data to the display panel.

For example, in the embodiments of the present disclosure, the processing chip includes: a field programmable gate array chip.

For example, in the embodiments of the present disclosure, the memory includes: a double data rate synchronous dynamic random access memory.

At least one embodiment of the present disclosure further provides a display device, which includes: a display panel and any one of the above-mentioned display driving device, wherein the display panel is configured to receive the display data transmitted by the display driving device.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

Figure 1:
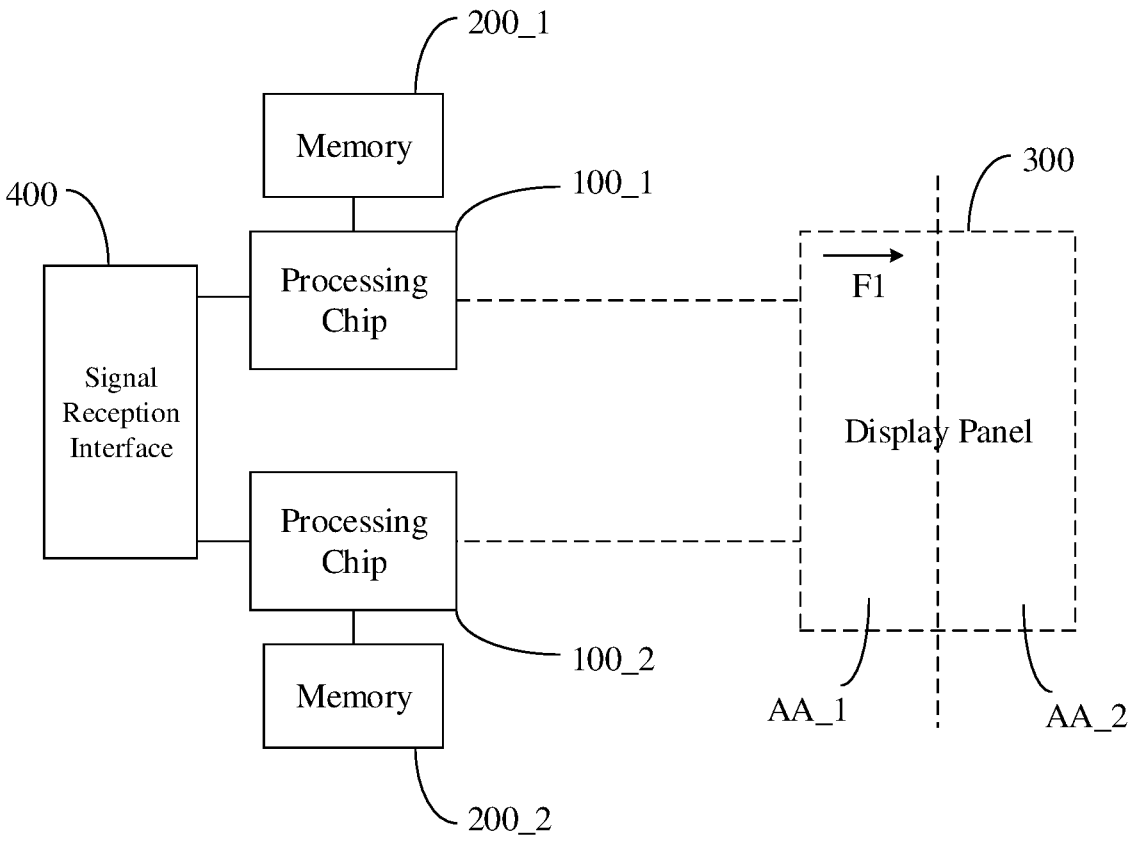
FIG. 1 is a schematic structural diagram of a display driving device according to at least one embodiment of the present disclosure.

In order to make objects, technical details and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

In practical designs, the memory bandwidth and the number of transmission interfaces of a processing chip are limited, which results in that a single processing chip may not meet the requirement of a high-resolution display panel, and therefore two or more processing chips are required. However, such design may not guarantee that display data output by each of a plurality of processing chips belongs to the same frame image, thereby causing abnormal display of the image, although fitting the design of high-resolution display panels.

Generally, the processing chip may be configured as a field programmable gate array (FPGA) chip. Therefore, the display data of the to-be-displayed frame image may be output to the display panel after being subjected to related image processing performed by the FPGA chip, so as to drive the display panel and realize image display. The general method is as follows. The display data of a plurality of to-be-displayed frame images are cached through the FPGA chip in a memory electrically connected with the FPGA chip, and then the display data cached in the memory is read and processed by the FPGA chip, and output to the display panel.

With the appearance of high-resolution display panels, requirements on the memory bandwidth and high-speed transmission interfaces become higher. In practical designs, the memory bandwidth and the number of transmission interfaces of a processing chip are limited, which results in that a single processing chip may not meet the requirement of the high-resolution display panel, and therefore two or more processing chips are required. Due to the arrangement of the plurality of FPGA chips, usually, a to-be-displayed frame image is divided into a plurality of regions, one region corresponds to one FPGA chip, and one FPGA chip is provided with one memory correspondingly. The display data of the same region corresponding to a plurality of to-be-displayed frame images is stored in the corresponding memory in sequence by each FPGA chip, and then, the display data in the corresponding memory is read, processed and output to the display panel. This design may meet the requirements of high-resolution display panels.

In order to ensure that the display data output by each of the plurality of FPGA chips can all belong to the same frame image, the frame addresses of the memories is usually shared between the FPGA chips. That is, when the display data of a certain to-be-displayed frame image is stored into the frame address of the corresponding memory by one FPGA chip, the frame addresses of the memories corresponding to other FPGA chips also change synchronously, so as to synchronously store the display data of the to-be-displayed frame image into the frame addresses of the corresponding memories. However, in the case where the memory initialization fails or the transmission interface may not be locked, the frame address of the memory of a certain FPGA chip may be suddenly changed, for example, reset. Since the frame addresses of the memories are shared among the FPGA chips, if the frame address of the memory of a certain FPGA chip changes suddenly, the frame addresses of the memories of the other FPGA chips also change suddenly. This may cause that the display data stored in and read from the memory by each FPGA chip may not belong to the same frame image, thereby causing abnormal display of the image.

In view of the above, as shown in FIG. 1, an embodiment of the present disclosure provides a display driving device, which may include: at least two processing chips 100_*m* (M is an integer greater than or equal to 1 and less than or equal to M, and M, as a total number of processing chips, is an integer greater than 1, in FIG. 1, M=2 is taken as an example), and memories 200_*m* electrically connected to the processing chips 100_*m* in a one-to-one correspondence. Each memory 200_*m* includes a plurality of frame addresses set in order, for example, the memory 200_*m* may have K frame addresses set in order, i.e., frame addresses 0, 1, 2 . . . K−1; wherein K is an integer greater than 1.

Moreover, each to-be-displayed frame image may include at least two image regions AA_m, and in the same to-be-displayed frame image, each image region AA_m corresponds to one processing chip 100_*m*. For example, the image region AA_1 corresponds to the processing chip 100_1, and the image region AA_2 corresponds to the processing chip 100_2, and so on, which is not described in detail herein. One of the M processing chips is defined as a master processing chip, and the rest of the processing chips are defined as slave processing chips. For example, the processing chip 100_1 is defined as a master processing chip, and the processing chips 100_2 to 100_M are defined as slave processing chips.

Figure 2:
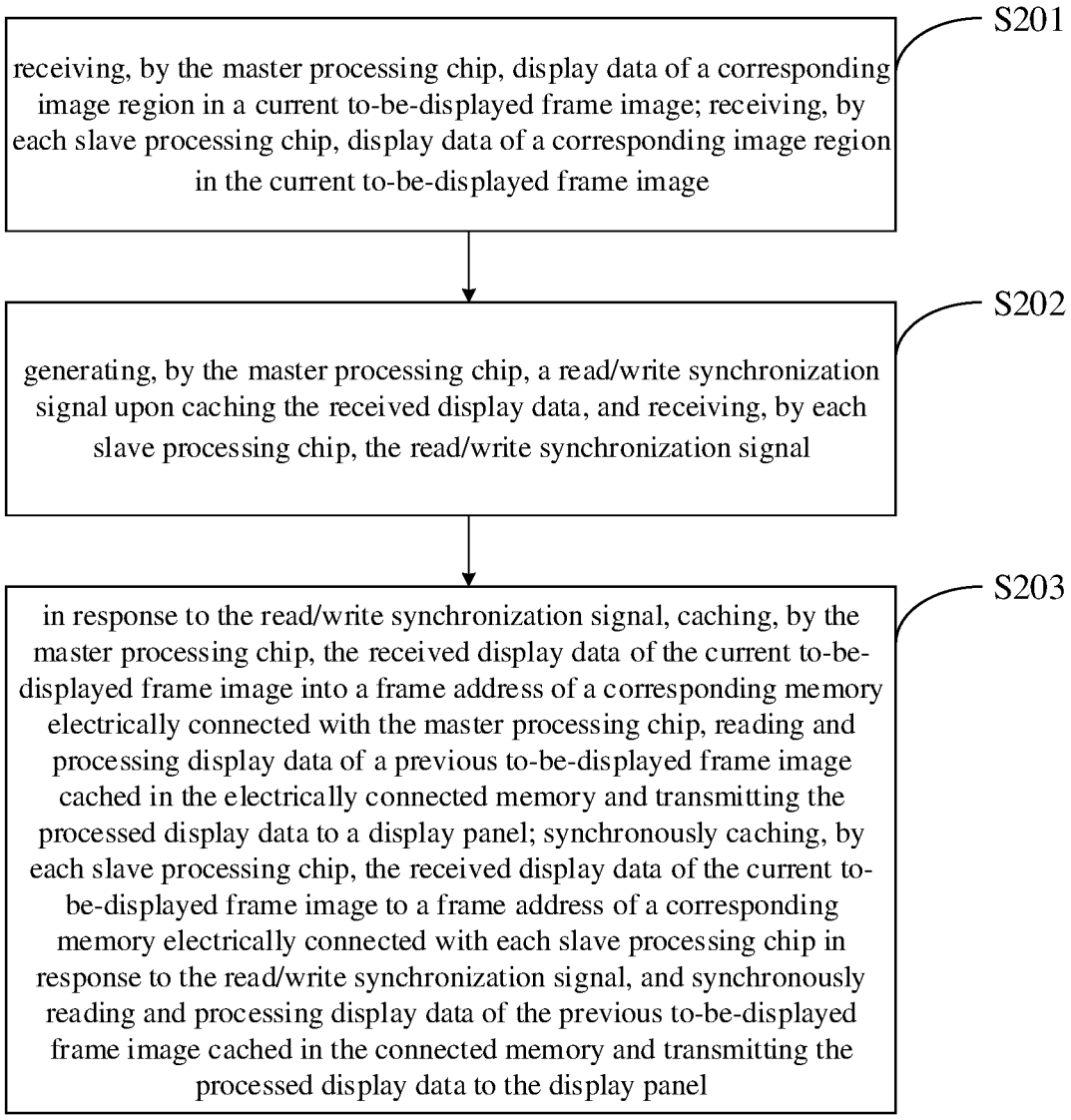
FIG. 2 is a flow chart of a control method according to at least one embodiment of the present disclosure.

As shown in FIG. 2, a control method of the display driving device according to an embodiment of the present disclosure may include:

S201, receiving, by the master processing chip, display data of a corresponding image region in a current to-be-displayed frame image; receiving, by each slave processing chip, display data of a corresponding image region in the current to-be-displayed frame image;

S202, generating, by the master processing chip, a read/write synchronization signal upon caching the received display data, and receiving, by each slave processing chip, the read/write synchronization signal;

S203, in response to the read/write synchronization signal, caching, by the master processing chip, the received display data of the current to-be-displayed frame image into a frame address of a corresponding memory electrically connected with the master processing chip, reading and processing display data of a previous to-be-displayed frame image cached in the electrically connected memory and transmitting the processed display data to a display panel; synchronously caching, by each slave processing chip, the received display data of the current to-be-displayed frame image to a frame address of a corresponding memory electrically connected with each slave processing chip in response to the read/write synchronization signal, and synchronously reading and processing display data of the previous to-be-displayed frame image cached in the connected memory and transmitting the processed display data to the display panel. In an embodiment, in response to the read/write synchronization signal, the master processing chip and each slave processing chip synchronously cache the received display data of the current to-be-displayed frame image into the frame addresses of the corresponding memories electrically connected with the master processing chip and each slave processing chip, synchronously read and process the display data of the previous to-be-displayed frame image cached in the connected memories and transmit the processed display data to the display panel.

In the control method of the display driving device according to the embodiment of the present disclosure, the arrangement of one master processing chip and a plurality of slave processing chips may facilitate the design of the high-resolution display panel. When caching the received display data of the corresponding image region in the current to-be-displayed frame image, the master processing chip may generate and transmit the read/write synchronization signal to each slave processing chip. By the read/write synchronization signal controlling the master processing chip and each slave processing chip, the received display data of the current to-be-displayed frame image is cached into the frame addresses of the electrically connected corresponding memories, and the display data of the previous to-be-displayed frame image cached in the electrically connected memories is read and processed and then transmitted to the display panel, so as to drive the display panel to display the image. Since the master processing chip and each slave processing chip are controlled by the read/write synchronization signal to control the storage and reading operations of the memories, the frame addresses of the memories are prevented from being shared among the processing chips, so that when the frame address of the memory corresponding to a certain processing chip changes suddenly, the frame addresses of the memories corresponding to the other processing chips may not be influenced, thereby ensuring that the display data output by each processing chip belong to the same frame image, thereby eliminating the problem of abnormal image display caused by the asynchronization of the plurality of processing chips.

In particular implementations, as shown in FIG. 1, M=2, so that two processing chips 100_1 to 100_2 and two memories 200_1 to 200_2 may be provided. Alternatively, M=3, so that three processing chips 100_1 to 100_3 and three memories 200_1 to 200_3 may be provided. Alternatively, M=4, so that four processing chips 100_1 to 100_4 and four memories 200_1 to 200_4 may be provided. Certainly, different application environments have different requirements on the value of M, so the value of M may be designed and determined according to the actual application environment, which is not limited herein.

In particular implementations, as shown in FIG. 1, each processing chip **100_*m* is connected to the same signal reception interface 400, so as to receive the display data of the to-be-displayed frame image through the signal reception interface 400. In the embodiment of the present disclosure, the frame address of the memory, which is electrically connected to the master processing chip, for caching the display data of the current to-be-displayed frame image may be the same as the frame address of the memory, which is electrically connected to each slave processing chip, for caching the display data of the current to-be-displayed frame image. This makes the frame addresses for reading the stored display data from the memories the same. For example, with a certain video having 300 continuous images, the memory 200_*m* may store 3 frame addresses: frame address 0, frame address 1, and frame address 2. The master processing chip 100_1 stores the display data of the corresponding image region AA_m in the first to-be-displayed frame image in the frame address 0 of the corresponding memory 200_1, and the slave processing chips 100_2 to 100_M also store the display data of corresponding image regions AA_m in the first to-be-displayed frame image in the frame addresses 0 of the corresponding memories 200_2 to 100_M. The master processing chip 100_1 stores the display data of the corresponding image region AA_m in the second to-be-displayed frame image in the frame address 1 of the corresponding memory 200_1, and the slave processing chips 100_2 to 100_M also store the display data of the corresponding image regions AA_m in the second to-be-displayed frame image in the frame addresses 1 of the corresponding memories 200_2 to 100**_M. The rest is the same and not repeated herein. Certainly, in practical applications, the frame address of the memory, which is electrically connected to the master processing chip, for caching the display data of the current to-be-displayed frame image may be different from the frame address of the memory, which is electrically connected to each of the slave processing chips, for caching the display data of the current to-be-displayed frame image, which is not limited herein.

Further, in particular implementations, in the memory, the order of the frame address caching the display data of the previous to-be-displayed frame image may be before the order of the frame address caching the display data of the current to-be-displayed frame image. This ensures that the read frame address is located before the stored frame address, thereby avoiding the problem of display abnormality. For example, the processing chip **100_*m* stores the display data of the corresponding image region AA_m in the first to-be-displayed frame image in the frame address 0 of the corresponding memory 200_*m*, and then, the processing chip 100_*m*, in response to the read/write synchronization signal, stores the display data of the corresponding image region AA_m in the second to-be-displayed frame image in the frame address 1 of the corresponding memory 200_*m*, and reads and converts the display data of the first to-be-displayed frame image stored in the frame address 0 of the corresponding memory 200_*m* and transmits the display data to the display panel. Subsequently, in response to the read/write synchronization signal, the processing chip 100_*m* stores the display data of the corresponding image region AA_m in the third to-be-displayed frame image in the frame address 2 of the corresponding memory 200_*m*, reads and converts the display data of the second to-be-displayed frame image stored in the frame address 1 of the corresponding memory 200**_*m*, and then transmits the display data to the display panel. The rest are the same and not repeated herein.

In particular implementations, each processing chip 100_*m* may be configured to receive the display data of the corresponding image region AA_m in at least two to-be-displayed frame images, to circularly cache the received display data of the at least two to-be-displayed frame images into the frame addresses of the electrically connected memory 200_*m* in sequence in response to the read/write synchronization signal, and to circularly read and convert the display data of the to-be-displayed frame images cached in the corresponding memory 200_*m* in sequence and then transmit the read display data to the display panel. In an embodiment, each processing chip 100_*m* may be configured to receive the display data of the corresponding image regions AA_m of at least two to-be-displayed frame images, in response to the read/write synchronization signal, cache the received display data of the at least two to-be-displayed frame images into the electrically connected memory 200_*m* by circularly using a plurality of frame addresses of the electrically connected memory 200_*m* in sequence (e.g., circularly caching in the order of the frame address 1, the frame address 2, the frame address 0, the frame address 1, the frame address 2 . . . ), and based on the plurality of frame addresses of the memory 200_*m*, circularly read and convert the display data of the to-be-displayed frame image cached in the corresponding memory 200_*m* in sequence, and transmit the converted display data to the display panel (for example, circularly reading the display data in the order of the frame address 0, the frame address 1, the frame address 2, the frame address 0 and the frame address 1 . . . ). This avoids storing and reading the same frame address in the memory, thereby avoiding the problem of display abnormality.

Specifically, the memory 200_*m* may store N frame addresses. For example, taking N=3 as an example, the memory 200_*m* may store 3 frame addresses: frame address 0, frame address 1, and frame address 2. For example, a new video has 300 continuous images, and the processing chip 100_*m* circularly receives the display data of the corresponding image region AA_m in the three to-be-displayed frame images. The processing chip 100_*m* circularly caches the received display data of the three to-be-displayed frame images (i.e. the display data of the three continuous to-be-displayed frame images) in sequence into the frame addresses of the electrically connected memory 200_*m*, and circularly reads and converts the display data of the three to-be-displayed frame images cached in the corresponding memory 200_*m* in sequence and then transmits the read display data to the display panel, which may be as follows. In response to the read/write synchronization signal, the display data of the first to-be-displayed frame image of the new video is stored in the frame address 0 of the corresponding memory 200_*m*, and the display data of the to-be-displayed frame image of the previous video stored in the frame address 0 is read, converted and transmitted to the display panel. Subsequently, in response to the read/write synchronization signal, the display data of the second to-be-displayed frame image is stored in the frame address 1 of the corresponding memory 200_*m*, the display data of the first to-be-displayed frame image stored in the frame address 0 is read and converted, and then transmitted to the display panel, so that the display panel displays the first to-be-displayed frame image. Afterwards, in response to the read/write synchronization signal, the display data of the third to-be-displayed frame image is stored in the frame address 2 of the corresponding memory 200_*m*, the display data of the second to-be-displayed frame image stored in the frame address 1 is read and converted, and then transmitted to the display panel, so that the display panel displays the second to-be-displayed frame image. Subsequently, in response to the read/write synchronization signal, the display data of the fourth to-be-displayed frame image is stored in the frame address 0 of the corresponding memory 200_*m*, the display data of the third to-be-displayed frame image stored in the frame address 2 is read and converted, and then transmitted to the display panel, so that the display panel displays the third to-be-displayed frame image. Afterwards, in response to the read/write synchronization signal, the display data of the fifth to-be-displayed frame image is stored in the frame address 1 of the corresponding memory 200_*m*, the display data of the fourth to-be-displayed frame image stored in the frame address 0 is read and converted, and then transmitted to the display panel, so that the display panel displays the fourth to-be-displayed frame image. Subsequently, in response to the read/write synchronization signal, the display data of the sixth to-be-displayed frame image is stored in the frame address 2 of the corresponding memory 200_*m*, the display data of the fifth to-be-displayed frame image stored in the frame address 1 is read and converted, and then transmitted to the display panel, so that the display panel displays the fifth to-be-displayed frame image. Afterwards, reading is circularly performed in the order of the frame address 0, the frame address 1 and the frame address 2, and circular reading is performed in the order of the frame address 2, the frame address 0 and the frame address 1 to drive the display panel to display, which is not repeated herein.

Further, in order to synchronize the drive timing of the display data received by each processing chip, in particular implementations, in the embodiment of the present disclosure, the master processing chip further receives a frame start signal upon receiving the display data of the corresponding image region in the current to-be-displayed frame image, and the slave processing chip further receives the frame start signal upon receiving the display data of the corresponding image region in the current to-be-displayed frame image. Namely, each processing chip also receives the frame start signal upon receiving the display data of the corresponding image region in the current to-be-displayed frame image.

For example, before the master processing chip generates the read/write synchronization signal upon caching the received display data and each slave processing chip receives the read/write synchronization signal, the control method according to at least one embodiment of the present disclosure may further include:

generating, by the master processing chip, a frame start synchronization signal according to the frame start signal, and receiving, by the slave processing chip, the frame start synchronization signal;

generating, by the master processing chip in response to the frame start synchronization signal and the frame start signal, the drive timing corresponding to the display data received by the master processing chip; synchronously generating, by each slave processing chip in response to the frame start synchronization signal and the frame start signal, the drive timing corresponding to the display data received from the slave processing chip.

For example, after the master processing chip generates the read/write synchronization signal upon caching the received display data and each slave processing chip receives the read/write synchronization signal, the control method according to at least one embodiment of the present disclosure may include:

caching, by the master processing chip in response to the read/write synchronization signal, the received display data of the current to-be-displayed frame image and the corresponding drive timing into the frame address of the corresponding memory which is electrically connected with the master processing chip, reading and processing the display data of the previous to-be-displayed frame image and the corresponding drive timing cached in the electrically connected memory and transmitting the processed display data to the display panel; synchronously caching, by each slave processing chip in response to the read/write synchronization signal, the received display data of the current to-be-displayed frame image and the corresponding drive timing into the frame address of the corresponding memory which is electrically connected with each slave processing chip, synchronously reading and processing the display data of the previous to-be-displayed frame image and the corresponding drive timing cached in the electrically connected memory, and transmitting the processed display data to the display panel. In an embodiment, in response to the read/write synchronization signal, the master processing chip and each slave processing chip synchronously cache the received display data of the current to-be-displayed frame image and the corresponding drive timing into the frame addresses of the corresponding memories which are electrically connected with the master processing chip and each slave processing chip, and synchronously read and process the display data of the previous to-be-displayed frame image and the corresponding drive timing cached in the electrically connected memories and transmit the processed display data to the display panel.

Therefore, the master processing chip also receives the frame start signal upon receiving the display data of the corresponding image region in the current to-be-displayed frame image, and generates the frame start synchronization signal according to the frame start signal; then, generates the drive timing corresponding to the display data received by the master processing chip in response to the frame start synchronization signal and the frame start signal. Subsequently, the read/write synchronization signal is generated upon the master processing chip caches the received display data, to cache the received display data of the current to-be-displayed frame image and the corresponding drive timing into the frame address of the electrically connected corresponding memory in response to the read/write synchronization signal, read and process the display data of the previous to-be-displayed frame image and the corresponding drive timing cached in the electrically connected memory, and transmit the processed display data to the display panel. The slave processing chip also receives the frame start signal upon receiving the display data of the corresponding image region in the current to-be-displayed frame image; and the slave processing chip also receives the frame start synchronization signal transmitted from the master processing chip, and generates the drive timing corresponding to the display data received by the slave processing chip in synchronization with the master processing chip in response to the frame start synchronization signal and the frame start signal. Subsequently, each slave processing chip receives the read/write synchronization signal, so as to cache the received display data of the current to-be-displayed frame image and the corresponding drive timing in synchronization with the master processing chip into the frame address of the electrically connected corresponding memory in response to the read/write synchronization signal, and reads and processes the display data of the previous to-be-displayed frame image and the corresponding drive timing cached in the electrically connected memory in synchronization with the master processing chip and transmit the processed display data to the display panel. Therefore, the master processing chip may determine the start of a frame image through the frame start signal, so as to generate the frame start synchronization signal, and simultaneously control the drive timing of the display data respectively received by the master processing chip and the slave processing chip through the frame start synchronization signal, so that the timing for driving the display data to display may be aligned, and the image may be refreshed synchronously.

In particular implementations, in the embodiment of the present disclosure, the image region in each to-be-displayed frame image may extend in a column direction of pixel units of the display panel and arranged in a row direction of the pixel units of the display panel. That is, each to-be-displayed frame image may include M image regions arranged in sequence in the row direction of the pixel units of the display panel. Taking M=2 as an example, as shown in FIG. 1, each to-be-displayed frame image may include two image regions AA_1 and AA_2 arranged in sequence in the row direction F1 of the pixel units of the display panel 300.

Figure 3:
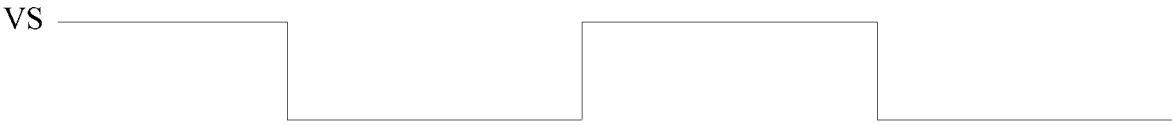
FIG. 3 is a schematic diagram of a VS signal according to at least one embodiment of the present disclosure.

Usually, as shown in FIG. 3, a VS signal is provided in the display panel, and is used for selecting an effective field signal interval in the display panel. For example, a falling edge of the VS signal indicates that the display data of a new to-be-displayed frame image starts to be sequentially transmitted according to the first to last row of pixel units in the display panel. In particular implementations, in the embodiment of the present disclosure, the frame start signal may be set as a field sync signal. This ensures that the memory stores the display data of the corresponding image region into the frame address in the order of the first to last row of pixel units.

Further, an HS signal, an effective display data strobe signal (DE) signal, or the like, are also provided in the display panel. In particular implementations, in the embodiment of the present disclosure, each processing chip may further receive at least one of the HS signal and the DE signal upon receiving the display data of the corresponding image region in the current to-be-displayed frame image, which is not limited herein. Certainly, the functions of the HS signal and the DE signal are substantially the same as the existing functions thereof, and it should be understood by those skilled in the art that the details are not described herein, and the present disclosure should not be limited thereto.

In particular implementations, in the embodiment of the present disclosure, the size of each image regions AA_m may be the same. Therefore, the data stored, read and processed by each processing chip is uniform, the power consumption of each processing chip is uniform, and the service life of each processing chip is uniform.

Based on the same inventive concept, at least one embodiment of the present disclosure further provides a display driving device adapted to implement the above-mentioned control method according to at least one embodiment of the present disclosure. As shown in FIG. 1, the master processing chip 100_1 is configured to receive the display data of the corresponding image region AA_1 in the current to-be-displayed frame image and generate the read/write synchronization signal, and the master processing chip 100_1 caches the received display data of the current to-be-displayed frame image in the frame address of the electrically connected corresponding memory 200_1 in response to the read/write synchronization signal, and reads and processes the display data of the previous to-be-displayed frame image cached in the electrically connected memory 200_1 and transmits the processed display data to the display panel 300.

Each of the slave processing chips 100_2 to 100_M (M is an integer greater than 1) is configured to receive the read/write synchronization signal and display data AA_2 to AA_M of the corresponding image region in the current to-be-displayed frame image, to synchronously cache the received display data of the current to-be-displayed frame image in the frame addresses of the electrically connected corresponding memories 200_2 to 200_M in response to the read/write synchronization signal, and to synchronously read and process the display data of the previous to-be-displayed frame image cached in the connected memories 200_2 to 200_M and transmit the processed display data to the display panel 300.

In an embodiment, in response to the read/write synchronization signal, the master processing chip 100_1 and each of the slave processing chips 100_2 to 100_M synchronously cache the received display data of the current to-be-displayed frame image into the frame addresses of the electrically connected corresponding memories 200_1 to 200_M, and synchronously read and process the display data of the previous to-be-displayed frame image cached in the connected memories 200_1 to 200_M and transmit the processed display data to the display panel 300.

In the display driving device according to the embodiment of the present disclosure, the arrangement of one master processing chip and at least one slave processing chip may facilitate the design of the high-resolution display panel. When the received display data of the corresponding image region in the current to-be-displayed frame image is cached by the master processing chip, the read/write synchronization signal may be generated and transmitted to each slave processing chip. By the read/write synchronization signal controlling the master processing chip and each slave processing chip, the received display data of the current to-be-displayed frame image is cached into the frame addresses of the electrically connected corresponding memories, and the display data of the previous to-be-displayed frame image cached in the electrically connected memory is read and processed and then transmitted to the display panel, so as to drive the display panel to display the image. Since the master processing chip and each slave processing chip are controlled by the read/write synchronization signal to control the storage and reading operations of the memories, the frame addresses of the memories are prevented from being shared among the processing chips, so that when the frame address of the memory corresponding to a certain processing chip changes suddenly, the frame addresses of the memories corresponding to the other processing chips may not be influenced, thereby ensuring that the display data output by each processing chip belong to the same frame, and further eliminating the problem of abnormal image display caused by the asynchronization of the plurality of processing chips.

For example, the display driving device according to the embodiment of the present disclosure may be applied to a 4K (3840×2160) display panel, an 8K (7680×4320) display panel, and the like, which is not limited in the embodiment of the present disclosure.

In particular implementations, in the embodiment of the present disclosure, each processing chip is configured to receive the display data of the corresponding image region in at least two to-be-displayed frame images; to cache the received display data of at least two to-be-displayed frame images into an electrically connected memory by circularly using a plurality of frame addresses of the electrically connected memory in sequence, and based on the plurality of frame addresses of the electrically connected memory, to circularly read and convert the display data of the to-be-displayed frame images cached in the electrically connected corresponding memory in sequence, and to transmit the converted display data to the display panel; wherein for each to-be-displayed frame image, in response to the read/write synchronization signal, the display data of the current to-be-displayed frame image is cached into the frame address of the electrically connected memory, and in response to the read/write synchronization signal, the display data of the previous to-be-displayed frame image cached in the connected memory is synchronously read and processed, and transmitted to the display panel.

In particular implementations, in the embodiment of the present disclosure, the master processing chip is further configured to receive the frame start signal upon receiving the display data of the corresponding image region in the current to-be-displayed frame image, and to generate the frame start synchronization signal according to the frame start signal; to generate the drive timing corresponding to the display data received by the master processing chip in response to the frame start synchronization signal and the frame start signal; to cache the received display data of the current to-be-displayed frame image and the corresponding drive timing into the frame address of the electrically connected corresponding memory in response to the read/write synchronization signal, read and process the display data of the previous to-be-displayed frame image and the corresponding drive timing cached in the electrically connected memory, and transmit the processed display data to the display panel.

The slave processing chip is further configured to receive the frame start synchronization signal and the frame start signal upon receiving the display data of the corresponding image region in the current to-be-displayed frame image; to synchronously generate the drive timing corresponding to the display data received from the slave processing chip in response to the frame start synchronization signal and the frame start signal; to synchronously cache the received display data of the current to-be-displayed frame image and the corresponding drive timing with the master processing chip into the frame address of the electrically connected corresponding memory in response to the read/write synchronization signal, and to synchronously read and process the display data of the previous to-be-displayed frame image and the corresponding drive timing cached in the electrically connected memory with the master processing chip and transmit the processed display data to the display panel.

In particular implementations, in embodiments of the present disclosure, the memory may include: Double Data Rate Synchronous Random Access Memory (DDR SDRAM). Certainly, in practical applications, the memory may also be other types of memory, which is not limited herein.

Figure 4:
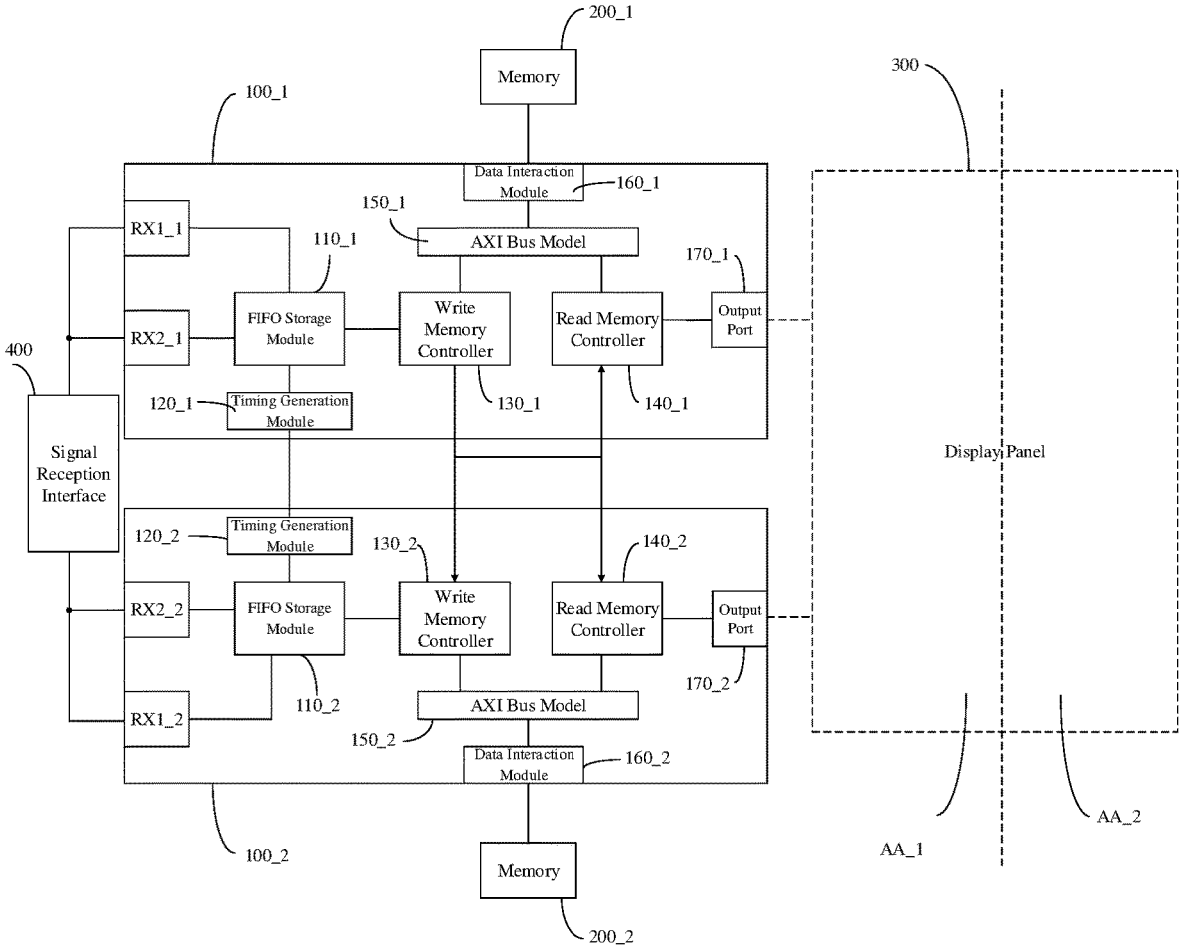
FIG. 4 is a schematic diagram illustrating a detailed structure of a display driving device according to at least one embodiment of the present disclosure.

In particular implementations, in the embodiment of the present disclosure, the processing chip 100_*m* may include:

a field programmable gate array chip (FPGA chip). As shown in FIG. 4, the FPGA chip in the processing chip 100_*m* may include: input interfaces RX1_*m* and RX2_*m*, a First Input First Output (FIFO) storage module 110_*m*, a timing generation module 120_*m*, a write memory controller 130_*m*, a read memory controller 140_*m*, and an output port 170_*m*. Certainly, in practical applications, the processing chip may also be other chips, which is not limited herein. For example, the above-mentioned FIFO storage module 110, the timing generation module 120_*m*, the write memory controller 130_*m*, and the read memory controller 140_*m* may be implemented by software, hardware, firmware, or a combination thereof.

In particular implementations, the input interfaces RX1_*m* and RX2_*m* are electrically connected with a signal reception interface 400. The input interfaces RX1_*m* and RX2_*m* may include: high Definition Multimedia Interfaces (HDMI), such as an HDMI 2.0 interface. Certainly, the input interfaces RX1_*m* and RX2_*m* may also be other interfaces capable of achieving the effects of the present disclosure, and are not limited herein.

In particular implementations, the FIFO storage module may be an FIFO memory, which may be a Random Access Memory (RAM) inside the FPGA chip, for storing the display signals received by the input interfaces RX1_*m* and RX2_*m*. Moreover, the FIFO memory in the master processing chip is further configured to generate the frame start synchronization signal according to the frame start signal, and provide it to the timing generation module 120_1 in each slave processing chip. Moreover, the structure of the FIFO memory may be substantially the same as existing structures and variations thereof, and will not be described herein.

In particular implementations, the timing generation module 120_*m* may include a timing generator for synchronously generating the drive timing corresponding to the display data received by each processing chip 100_*m* in response to the frame start synchronization signal and the corresponding frame start signal.

In particular implementations, the write memory controller 130_*m* may include a Write Direct Memory Access (WDMA) engine. Moreover, the structure of the WDMA engine may be substantially the same as existing structures and variations thereof, and will not be described herein.

In particular implementations, the read memory controller 140_*m* may include a Read Direct Memory Access (RDMA) engine. Moreover, the structure of the RDMA engine may be substantially the same as existing structures and variations thereof, and will not be described herein.

In particular implementations, the output port 170_*m* may include a V-By-One interface. Moreover, the structure of the V-By-One interface may be substantially the same as existing structures and variations thereof, and will not be described herein.

Further, as shown in FIG. 4, usually, the FPGA chip in the processing chip 100_*m* may further include: an AXI (advanced eXtensible interface) bus module 150_*m* and a data interaction module 160_*m*; wherein the write memory controller 130_*m* may perform data interaction with the memory 200_*m* through the AXI bus module 150_*m* and the data interaction module 160_*m*. Further, the data interaction module 160_*m* may also be configured to initialize the underlying storage in the memory 200_*m*. The structures of the AXI bus module 150_*m* and the data interaction module 160_*m* may be substantially the same as existing structures and variations thereof, which are not described herein.

Particularly, taking the structure of the drive device shown in FIG. 4 as an example, the operation process of the drive device according to the embodiment of the present disclosure will be described. The description will be made by taking the frame addresses stored in the memory 200_*m* being: the frame address 0, the frame address 1, and the frame address 3 as an example.

The master processing chip 100_1 receives the frame start signal and the display data of the corresponding image region AA_1 in the first to-be-displayed frame image through the input interfaces RX1_1 and RX2_1, and stores the frame start signal and the received display data of the corresponding image region AA_1 in the current to-be-displayed frame image into the FIFO storage module 110_1. The slave processing chip 100_2 receives the frame start signal and the display data of the corresponding image region AA_2 in the first to-be-displayed frame image through the input interfaces RX1_2 and RX2_2, and stores the received frame start signal and the received display data of the corresponding image region AA_2 in the current to-be-displayed frame image into the FIFO storage module 110_2.

The FIFO storage module 110_1 generates a frame start synchronization signal FS_1 according to the frame start signal, and transmits the frame start synchronization signal FS_1 to the timing generation module 120_1 of the master processing chip 100_1 and the timing generation module 120_2 of the slave processing chip 100_2.

The timing generation module 120_1 in the master processing chip 100_1 generates a drive timing corresponding to the display data received by the master processing chip 100_1 in response to the frame start synchronization signal FS_1 and the corresponding frame start signal. Also, the timing generation module 120_2 in the slave processing chip 100_2 synchronously generates a drive timing corresponding to the display data received by the slave processing chip 100_2 in response to the frame start synchronization signal FS_1 and the corresponding frame start signal, so as to perform synchronous processing on the display data received by the master processing chip 100_1 and the slave processing chip 100_2, so that the display data in the two chips are aligned.

The write memory controller 130_1 in the master processing chip 100_1 receives the display data stored in the FIFO storage module 110_1 and the drive timing corresponding to the display data, generates a read/write synchronization signal DX_1, and transmits the read/write synchronization signal DX_1 to the read memory controller 140_1 in the master processing chip 100_1, the write memory controller 130_2 in the slave processing chip 100_2, and the read memory controller 140_2.

The write memory controller 130_1 in the master processing chip 100_1 caches the received display data of the first to-be-displayed frame image and the corresponding drive timing into the frame address 0 of the electrically connected memory 200_1 in response to the read/write synchronization signal DX_1, and reads and processes the display data of the previous to-be-displayed frame image and the corresponding drive timing cached in the memory 200_1 in response to the read/write synchronization signal DX_1, and transmits the processed display data to the display panel 200 through the port 170_1. Moreover, the write memory controller 130_2 in the slave processing chip 100_2 caches the received display data of the first to-be-displayed frame image and the corresponding drive timing into the frame address 0 of the electrically connected memory 200_2 in response to the read/write synchronization signal DX_1, and reads and processes the display data of the previous to-be-displayed frame image and the corresponding drive timing cached in the memory 200_2 in response to the read/write synchronization signal DX_1, and transmits the processed display data to the display panel 200 through the port 170_2. This enables the display panel 200 to display the previous frame image.

Then, the master processing chip 100_1 receives the frame start signal and the display data of the corresponding image region AA_1 in the second to-be-displayed frame image through the input interfaces RX1_1 and RX2_1, and stores the received frame start signal and the received display data of the corresponding image region AA_1 in the current to-be-displayed frame image into the FIFO storage module 110_1. The slave processing chip 100_2 receives the frame start signal and the display data of the corresponding image region AA_2 in the second to-be-displayed frame image through the input interfaces RX1_2 and RX2_2, and stores the received frame start signal and the received display data of the corresponding image region AA_2 in the current to-be-displayed frame image into the FIFO storage module 110_2.

The FIFO storage module 110_1 generates a frame start synchronization signal FS_2 according to the frame start signal, and transmits the frame start synchronization signal FS_2 to the timing generation module 120_1 of the master processing chip 100_1 and the timing generation module 120_2 of the slave processing chip 100_2.

The timing generation module 120_1 in the master processing chip 100_1 generates a drive timing corresponding to the display data received by the master processing chip 100_1 in response to the frame start synchronization signal FS_2 and the corresponding frame start signal. Also, the timing generation module 120_2 in the slave processing chip 100_2 synchronously generates a drive timing corresponding to the display data received by the slave processing chip 100_2 in response to the frame start synchronization signal FS_2 and the corresponding frame start signal, so as to perform synchronous processing on the display data received by the master processing chip 100_1 and the slave processing chip 100_2, so that the display data in the two chips are aligned.

The write memory controller 130_1 in the master processing chip 100_1 receives the display data stored in the FIFO storage module 110_1 and the drive timing corresponding to the display data, generates a read/write synchronization signal DX_2, and transmits the read/write synchronization signal DX_2 to the read memory controller 140_1 in the master processing chip 100_1, the write memory controller 130_2 in the slave processing chip 100_2, and the read memory controller 140_2.

The write memory controller 130_1 in the master processing chip 100_1 caches the received display data of the second to-be-displayed frame image and the corresponding drive timing into the frame address 1 of the electrically connected memory 200_1 in response to the read/write synchronization signal DX_2, and reads and processes the display data of the first to-be-displayed frame image and the corresponding drive timing cached in the memory 200_1 in response to the read/write synchronization signal DX_2, and transmits the processed display data to the display panel 200 through the port 170_1. Moreover, the write memory controller 130_2 in the slave processing chip 100_2 caches the received display data of the second to-be-displayed frame image and the corresponding drive timing into the frame address 1 of the electrically connected memory 200_2 in response to the read/write synchronization signal DX_2, and reads and processes the display data of the first to-be-displayed frame image and the corresponding drive timing cached in the memory 200_2 in response to the read/write synchronization signal DX_2, and transmits the processed display data to the display panel 200 through the port 170_2. This enables the display panel 200 to display the first frame image.

Then, the master processing chip 100_1 receives the frame start signal and the display data of the corresponding image region AA_1 in the third to-be-displayed frame image through the input interfaces RX1_1 and RX2_1, and stores the received frame start signal and the received display data of the corresponding image region AA_1 in the current to-be-displayed frame image into the FIFO storage module 110_1. The slave processing chip 100_2 receives the frame start signal and the display data of the corresponding image region AA_2 in the third to-be-displayed frame image through the input interfaces RX1_2 and RX2_2, and stores the received frame start signal and the received display data of the corresponding image region AA_2 in the current to-be-displayed frame image into the FIFO storage module 110_2.

The FIFO storage module 110_1 generates a frame start synchronization signal FS_3 according to the frame start signal, and transmits the frame start synchronization signal FS_3 to the timing generation module 120_1 of the master processing chip 100_1 and the timing generation module 120_2 of the slave processing chip 100_2.

The timing generation module 120_1 in the master processing chip 100_1 generates a drive timing corresponding to the display data received by the master processing chip 100_1 in response to the frame start synchronization signal FS_3 and the corresponding frame start signal. Also, the timing generation module 120_2 in the slave processing chip 100_2 synchronously generates a drive timing corresponding to the display data received by the slave processing chip 100_2 in response to the frame start synchronization signal FS_3 and the corresponding frame start signal, so as to perform synchronous processing on the display data received by the master processing chip 100_1 and the slave processing chip 100_2, so that the display data in the two chips are aligned.

The write memory controller 130_1 in the master processing chip 100_1 receives the display data stored in the FIFO storage module 110_1 and the drive timing corresponding to the display data, generates a read/write synchronization signal DX_3, and transmits the read/write synchronization signal DX_3 to the read memory controller 140_1 in the master processing chip 100_1, the write memory controller 130_2 in the slave processing chip 100_2, and the read memory controller 140_2.

The write memory controller 130_1 in the master processing chip 100_1 caches the received display data of the third to-be-displayed frame image and the corresponding drive timing into the frame address 2 of the electrically connected memory 200_1 in response to the read/write synchronization signal DX_3, and reads and processes the display data of the second to-be-displayed frame image and the corresponding drive timing cached in the memory 200_1 in response to the read/write synchronization signal DX_2, and transmits the processed display data to the display panel 200 through the port 170_1. Moreover, the write memory controller 130_2 in the slave processing chip 100_2 caches the received display data of the third to-be-displayed frame image and the corresponding drive timing into the frame address 2 of the electrically connected memory 200_2 in response to the read/write synchronization signal DX_3, and reads and processes the display data of the second to-be-displayed frame image and the corresponding drive timing cached in the memory 200_2 in response to the read/write synchronization signal DX_3, and transmits the processed display data to the display panel 200 through the port 170_1. This enables the display panel 200 to display the second frame image. The rest may be done in the same manner, and is not described in detail herein.

In some embodiments of the present disclosure, the frame address of the memory, which is electrically connected to the master processing chip, for caching the display data of the current to-be-displayed frame image may be the same as the frame address of the memory, which is electrically connected to each slave processing chip, for caching the display data of the current to-be-displayed frame image. This makes the frame address for reading the stored display data from the memory the same. Certainly, in some other embodiments, the frame address of the memory electrically connected to the master processing chip for caching the display data of the current to-be-displayed frame image may be different from the frame address of the memory electrically connected to each of the slave processing chips for caching the display data of the current to-be-displayed frame image, which is not limited in the embodiments of the present disclosure.

Figure 5:
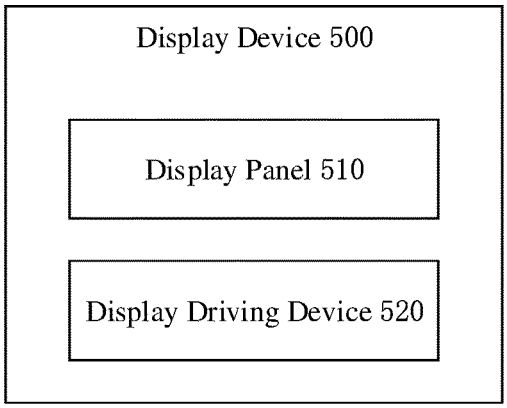
FIG. 5 is a schematic structural diagram of a display device according to at least one embodiment of the present disclosure.

Based on the same inventive concept, the embodiment of the present disclosure further provides a display device. As shown in FIG. 5, the display device 500 includes a display panel 510 and the display driving device 520 according to the embodiment of the present disclosure. The display panel 510 is configured to receive display data transmitted by the display driving device 520. The display panel 510 includes, for example, but is not limited to, a 4K (3840×2160) display panel, an 8K (7680×4320) display panel, or the like. With respect to the implementation of the display device, reference may be made to the above-mentioned embodiments of the display driving device, and the repeated description will not be provided herein.

In particular implementations, in the embodiment of the present disclosure, the display panel may be, for example, a liquid crystal display panel or an electroluminescence display panel, which is not limited herein.

In particular implementations, in the embodiment of the present disclosure, the display device may be any product or component with a display function, such as a mobile phone, a tablet computer, a television, a display panel, a notebook computer, a digital photo frame, a navigator, or the like. Other essential components of the display device are understood to be necessary by those skilled in the art, and are not described herein, without being construed as limiting the present disclosure.

In the display driving device, control method thereof and display device according to the embodiment of the present disclosure, the arrangement of one master processing chip and at least one slave processing chip may facilitate the design of the high-resolution display panel. When the received display data of the corresponding image region in the current to-be-displayed frame image is cached by the master processing chip, the read/write synchronization signal may be generated and transmitted to each slave processing chip. By the read/write synchronization signal controlling the master processing chip and each slave processing chip, the received display data of the current to-be-displayed frame image is cached into the frame addresses of the electrically connected corresponding memories, and the display data of the previous to-be-displayed frame image cached in the electrically connected memory is read and processed and then transmitted to the display panel, so as to drive the display panel to display the image. Since the storage and reading operations of the memory are controlled by the read/write synchronization signal controlling the master processing chip and each slave processing chip, the frame addresses of the memories are prevented from being shared among the processing chips, so that when the frame address of the memory corresponding to a certain processing chip changes suddenly, the frame addresses of the memories corresponding to the other processing chips may not be influenced, thereby ensuring that the display data output by each processing chip belong to the same frame, and further eliminating the problem of abnormal image display caused by the asynchronization of the plurality of processing chips.

The above description relates to only exemplary embodiments of the present disclosure and is not intended to limit the scope of the present disclosure; the scopes of the disclosure are defined by the accompanying claims.

What is claimed is:

1. A control method of a display driving device, the display driving device comprising:

at least two processing chips and at least one memory in signal connection with the at least two processing chips; the at least one memory comprising a plurality of frame addresses set in order; each to-be-displayed frame image comprising at least two image regions, and the at least two image regions being in a one-to-one correspondence with the at least two processing chips; one of the at least two processing chips being a master processing chip, and a remainder of the at least two processing chips being a slave processing chip;

wherein the control method comprises:

receiving, by the master processing chip, display data of a corresponding image region in a current to-be-displayed frame image; receiving, by each of the slave processing chip, display data of a corresponding image region in the current to-be-displayed frame image;

generating, by the master processing chip, a read/write synchronization signal upon caching the received display data, and receiving, by each of the slave processing chip, the read/write synchronization signal;

in response to the read/write synchronization signal, caching, by the master processing chip, the received display data of the current to-be-displayed frame image into the frame address of a memory of the at least one memory in signal connection with the master processing chip, reading and processing display data of a previous to-be-displayed frame image cached in the memory of the at least one memory in signal connection with the master processing chip and transmitting the processed display data to a display panel; and in response to the read/write synchronization signal, caching, by each of the slave processing chip, the received display data of the current to-be-displayed frame image into the frame address of a memory of the at least one memory in signal connection with each of the slave processing chip in synchronization with the master processing chip, and reading and processing display data of the previous to-be-displayed frame image cached in the memory of the at least one memory in signal connection with each of the slave processing chip in synchronization with the master processing chip and transmitting the processed display data to the display panel.

2. The control method of according to claim 1, wherein the at least one memory comprises a plurality of memories, and the memories are signally connected with the at least two processing chips in a one-to-one correspondence.

3. The control method according to claim 2, further comprising: receiving, by the master processing chip, a frame start signal upon receiving the display data of the corresponding image region in the current to-be-displayed frame image; receiving, by the slave processing chip, the frame start signal upon receiving the display data of the corresponding image region in the current to-be-displayed frame image; and prior to the generating, by the master processing chip, the read/write synchronization signal upon caching the received display data, and receiving, by each of the slave processing chip, the read/write synchronization signal, the control method further comprising:

generating, by the master processing chip, a frame start synchronization signal according to the frame start signal, and receiving, by the slave processing chip, the frame start synchronization signal; and generating, by the master processing chip, a drive timing corresponding to the display data received by the master processing chip, in response to the frame start synchronization signal and the frame start signal; generating, by each of the slave processing chip, a drive timing corresponding to the display data received by the slave processing chip in synchronization with the master processing chip, in response to the frame start synchronization signal and the frame start signal.

4. The control method according to claim 3, wherein subsequent to the generating, by the master processing chip, the read/write synchronization signal upon caching the received display data, and receiving, by each of the slave processing chip, the read/write synchronization signal, the control method further comprises:

in response to the read/write synchronization signal, caching, by the master processing chip, the received display data of the current to-be-displayed frame image and the corresponding drive timing into the frame address of a memory of the memories in signal connection with the master processing chip, reading and processing the display data of the previous to-be-displayed frame image and a corresponding drive timing cached in the memory of the memories in signal connection with the master processing chip and transmits the processed display data to the display panel; and in response to the read/write synchronization signal, synchronously caching, by each of the slave processing chip, the received display data of the current to-be-displayed frame image and the corresponding drive timing into the frame address of a memory of the memories in signal connection with each of the slave processing chip in synchronization with the master processing chip, reading and processing the display data of the previous to-be-displayed frame image and a corresponding drive timing cached in the memory of the memories in signal connection with each of the slave processing chip in synchronization with the master processing chip and transmitting the processed display data to the display panel.

5. The control method according to claim 3, wherein the image regions in each of the to-be-displayed frame image extend in a column direction of pixel units of the display panel and are arranged in a row direction of the pixel units of the display panel; and the frame start signal is a field sync signal.

6. The control method according to claim 2, wherein in a memory of the memories, an order of the frame address caching the display data of the previous to-be-displayed frame image is before an order of the frame address caching the display data of the current to-be-displayed frame image.

7. The control method according to claim 2, wherein the frame address of a memory of the memories in signal connection with the master processing chip for caching the display data of the current to-be-displayed frame image is the same as the frame address of a memory of the memories in signal connection with each of the slave processing chip for caching the display data of the current to-be-displayed frame image.

8. The control method according to claim 2, wherein the frame address of a memory of the memories in signal connection with the master processing chip for caching the display data of the current to-be-displayed frame image is different from the frame address of a memory of the memories in signal connection with each of the slave processing chip for caching the display data of the current to-be-displayed frame image.

9. The control method according to claim 2, wherein sizes of the image regions are identical.

10. The control method according to claim 2, wherein the plurality of frame addresses of a memory of the memories in signal connection with the processing chip are used to store display data of each to-be-displayed frame image circularly in sequence.

11. A display driving device comprising:

at least two processing chips, at least one memory in signal connection with the at least two processing chips, wherein the at least one memory comprises a plurality of frame addresses set in order; each to-be-displayed frame image comprises at least two image regions, and the at least two image regions are in a one-to-one correspondence to the at least two processing chips; one of the at least two processing chips is a master processing chip, and a remainder of the at least two processing chips is a slave processing chip;

the master processing chip is configured to receive display data of a corresponding image region in a current to-be-displayed frame image and generate a read/write synchronization signal upon caching the received display data; in response to the read/write synchronization signal, to cache the received display data of the current to-be-displayed frame image into the frame address of a memory of the at least one memory in signal connection with the master processing chip, read and process display data of a previous to-be-displayed frame image cached in the memory of the at least one memory in signal connection with the master processing chip and transmit the processed display data to a display panel; and each of the slave processing chip is configured to receive display data of a corresponding image region in the current to-be-displayed frame image and the read/write synchronization signal; in response to the read/write synchronization signal, to cache the received display data of the current to-be-displayed frame image into the frame address of a memory of the at least one memory in signal connection with the master processing chip in synchronization with the master processing chip, and read and process display data of the previous to-be-displayed frame image cached in the memory of the at least one memory in signal connection with each of the slave processing chip in synchronization with the master processing chip and transmit the processed display data to the display panel.

12. The display driving device according to claim 11, wherein the at least one memory comprises a plurality of memories, and the memories are signally connected with the at least two processing chips in a one-to-one correspondence.

13. The display driving device according to claim 12, wherein the master processing chip is further configured to receive a frame start signal upon receiving the display data of the corresponding image region in the current to-be-displayed frame image, and generate a frame start synchronization signal according to the frame start signal; in response to the frame start synchronization signal and the frame start signal, to generate a drive timing corresponding to the display data received by the master processing chip; in response to the read/write synchronization signal, to cache the received display data of the current to-be-displayed frame image and the corresponding drive timing into the frame address of a memory of the memories in signal connection with the master processing chip, read and process the display data of the previous to-be-displayed frame image cached in the memory of the memories in signal connection with the master processing chip and a corresponding drive timing and transmit the processed display data and the processed corresponding drive timing to the display panel;

the slave processing chip is further configured to receive the frame start synchronization signal and receive the frame start signal upon receiving the display data of the corresponding image region in the current to-be-displayed frame image; in response to the frame start synchronization signal and the frame start signal, to generate a drive timing corresponding to the display data received by the slave processing chip in synchronization with the master processing chip; and in response to the read/write synchronization signal, to cache the received display data of the current to-be-displayed frame image and the corresponding drive timing into the frame address of a memory of the memories in signal connection with the slave processing chip in synchronization with the master processing chip, and read and process the display data of the previous to-be-displayed frame image cached in the memory of the memories in signal connection with the slave processing chip and a corresponding drive timing in synchronization with the master processing chip and transmit the processed display data and the processed corresponding drive timing to the display panel.

14. The display driving device according to claim 13, wherein each of the at least two processing chips is further configured to receive display data of a corresponding image region in at least two to-be-displayed frame images; to cache the received display data of the at least two to-be-displayed frame images into the memory of the memories in signal connection with the processing chip by circularly using the plurality of frame addresses of the memory of the memories in signal connection with the processing chip in sequence, and based on the plurality of frame addresses of the memory of the memories in signal connection with the processing chip, to circularly read and convert display data of the to-be-displayed frame image cached in the memory of the memories in signal connection with the processing chip in sequence, and to transmit the converted display data to the display panel; and the frame start signal is a field sync signal.

15. The display driving device according to claim 12, wherein in a memory of the memories, an order of the frame address caching the display data of the previous to-be-displayed frame image is before an order of the frame address caching the display data of the current to-be-displayed frame image.

16. The display driving device according to claim 12, wherein the frame address of a memory of the memories in signal connection with the master processing chip for caching the display data of the current to-be-displayed frame image is the same as the frame address of a memory of the memories in signal connection with each of the slave processing chip for caching the display data of the current to-be-displayed frame image.

17. The display driving device according to claim 12, wherein the frame address of a memory of the memories in signal connection with the master processing chip for caching the display data of the current to-be-displayed frame image is different from the frame address of a memory of the memories in signal connection with each of the slave processing chip for caching the display data of the current to-be-displayed frame image.

18. The display driving device according to claim 12, wherein the processing chip comprises a field programmable gate array chip.

19. The display driving device according to claim 12, wherein a memory of the memories comprises a double data rate synchronous dynamic random access memory.

20. A display device, comprising: a display panel and a display driving device, wherein the display driving device comprises:

at least two processing chips, at least one memory in signal connection with the at least two processing chips, wherein the at least one memory comprises a plurality of frame addresses set in order; each to-be-displayed frame image comprises at least two image regions, and the at least two image regions are in a one-to-one correspondence to the at least two processing chips; one of the at least two processing chips is a master processing chip, and a remainder of the at least two processing chips is a slave processing chip;

the master processing chip is configured to receive display data of a corresponding image region in a current to-be-displayed frame image and generate a read/write synchronization signal upon caching the received display data; in response to the read/write synchronization signal, to cache the received display data of the current to-be-displayed frame image into the frame address of a memory of the at least one memory in signal connection with the master processing chip, read and process display data of a previous to-be-displayed frame image cached in the memory of the at least one memory in signal connection with the master processing chip and transmit the processed display data to a display panel; and each of the slave processing chip is configured to receive display data of a corresponding image region in the current to-be-displayed frame image and the read/write synchronization signal; in response to the read/write synchronization signal, to cache the received display data of the current to-be-displayed frame image into the frame address of a memory of the at least one memory in signal connection with the master processing chip in synchronization with the master processing chip, and read and process display data of the previous to-be-displayed frame image cached the memory of the at least one memory in signal connection with each of the slave processing chip in synchronization with the master processing chip and transmit the processed display data to the display panel; and the display panel is configured to receive the display data transmitted by the display driving device.

* * * * *